US006698606B2

(12) United States Patent
Deubel et al.

(10) Patent No.: US 6,698,606 B2
(45) Date of Patent: Mar. 2, 2004

(54) HOT-FILLABLE CONTAINER WITH GRIP

(75) Inventors: Donald Deubel, New Lenox, IL (US); Satya Kamineni, Westmont, IL (US); Philip G. Kraft, Frankfort, IL (US); Richard G. Kraft, Shorewood, IL (US)

(73) Assignee: Constar International, Inc., Philadelphia, PA (US)

( * ) Notice: Subject to any disclaimer, the term of this patent is extended or adjusted under 35 U.S.C. 154(b) by 0 days.

(21) Appl. No.: 10/163,020

(22) Filed: Jun. 4, 2002

(65) Prior Publication Data

US 2003/0000912 A1 Jan. 2, 2003

Related U.S. Application Data

(60) Provisional application No. 60/295,911, filed on Jun. 4, 2001.

(51) Int. Cl.[7] ..... B65D 1/02; B65D 23/10

(52) U.S. Cl. ..... 215/384; 215/381; 215/382; 220/675; 220/771

(58) Field of Search ..... 215/381, 382, 215/384, 398, 900; 220/666, 771, 675

(56) References Cited

U.S. PATENT DOCUMENTS

| | | | | |
|---|---|---|---|---|
| D38,430 | S | 1/1907 | Pressing | |
| D66,789 | S | 3/1925 | Curran | D9/553 |
| D67,946 | S | 8/1925 | Council | D9/553 |
| 1,602,391 | A | 10/1926 | Creaver | 215/384 |
| 1,636,174 | A | 7/1927 | Dolan et al. | |
| D85,109 | S | 9/1931 | Mas | D9/553 |
| D91,653 | S | 3/1934 | Guyer | |
| D94,384 | S | 1/1935 | Fuerst | D9/543 |
| D144,247 | S | 3/1946 | Graham | D9/543 |
| D159,169 | S | 6/1950 | Smith | D58/25 |
| D171,647 | S * | 3/1954 | Hills | 215/384 X |
| D198,407 | S | 6/1964 | Busch | D58/5 |
| 3,152,710 | A | 10/1964 | Platte | 215/1 |
| 3,225,950 | A | 12/1965 | Josephsen et al. | 215/384 |
| 3,308,997 | A | 3/1967 | Kelly | 215/384 X |
| D217,439 | S | 5/1970 | Platte | D9/44 |
| 3,536,500 | A | 10/1970 | Cleereman et al. | 99/171 |
| 4,318,882 | A | 3/1982 | Agrawal et al. | 264/521 |
| D277,551 | S | 2/1985 | Kerr | D9/367 |
| 4,497,855 | A | 2/1985 | Agrawal et al. | 428/35 |
| D278,978 | S | 5/1985 | Franchi et al. | D9/383 |
| D279,167 | S | 6/1985 | Haney et al. | D9/378 |
| D281,577 | S | 12/1985 | Larson et al. | D9/367 |
| D282,349 | S | 1/1986 | Larson et al. | D9/395 |
| 4,570,808 | A | 2/1986 | Campbell et al. | 215/11 R |
| D294,462 | S | 3/1988 | Ota et al. | D9/392 |
| D294,463 | S | 3/1988 | Lang | D9/392 |
| 4,804,097 | A * | 2/1989 | Alberghini et al. | 215/384 |

(List continued on next page.)

FOREIGN PATENT DOCUMENTS

| | | |
|---|---|---|
| EP | 1 025 007 | 12/1999 |
| EP | 1 012 047 A1 | 6/2000 |
| JP | 10 139 028 | 5/1998 |
| WO | WO 99/08945 | 2/1999 |
| WO | WO 99/18013 | 4/1999 |
| WO | WO 00/35759 | 6/2000 |
| WO | WO 00/51895 | 9/2000 |

*Primary Examiner*—Sue A. Weaver
(74) *Attorney, Agent, or Firm*—Woodcock Washburn LLP

(57) ABSTRACT

A blow-molded plastic container is provided suitable for hot-filling under pressurize-fill conditions, and under gravity-fill conditions. The container includes opposing handgrips within panels, which lack hinges and thus do not function as conventional vacuum panels as the inward deformation is spread beyond the panels. The hand grip includes a distal, relatively stiffened portion formed by a sidewall that forms a thumb piece and a proximal, relatively un-stiffened portion the smooth merges into a cylindrical sidewall of the container.

32 Claims, 13 Drawing Sheets

(8 of 13 Drawing Sheet(s) Filed in Color)

U.S. PATENT DOCUMENTS 4,805,788 A 2/1989 Akiho ..... 215/1 C
4,813,556 A 3/1989 Lawrence ..... 215/11.3
4,863,046 A 9/1989 Collette et al. ..... 215/1 C
4,877,141 A 10/1989 Hayashi et al. ..... 215/1 C
4,885,809 A 12/1989 Muchmore ..... 4/259
4,890,752 A 1/1990 Ota et al. ..... 215/1 C
D305,984 S 2/1990 Alberghini et al. ..... D9/393
4,946,053 A 8/1990 Conrad ..... 215/1 C
4,969,922 A 11/1990 Platte, Sr. ..... 215/1 C
4,979,628 A 12/1990 Robbins, III ..... 215/1 C
4,993,565 A * 2/1991 Ota et al. ..... 215/384
4,993,566 A 2/1991 Eberle ..... 215/1 C
4,993,567 A 2/1991 Eberle, Jr. ..... 215/1 C
D315,869 S 4/1991 Collette ..... D9/392
5,005,716 A 4/1991 Eberle ..... 215/1 C
5,027,963 A 7/1991 Robbins, III ..... 215/1 C
D318,798 S 8/1991 Biesecker ..... D9/378
D320,154 S 9/1991 Alberghini et al. ..... D9/370
5,052,567 A 10/1991 Colani ..... 215/100 A
5,054,632 A 10/1991 Alberghini et al. ..... 215/1 C
D321,830 S 11/1991 York et al. ..... D9/434
5,064,081 A 11/1991 Hayashi et al. ..... 215/1 C
5,092,474 A 3/1992 Leigner ..... 215/1 C
5,092,475 A 3/1992 Krishnakumar et al. .... 215/1 C
5,103,988 A 4/1992 Reil et al. ..... 215/100 A
5,122,327 A 6/1992 Spina et al. ..... 264/534
5,141,120 A 8/1992 Brown et al. ..... 215/1 C
5,141,121 A 8/1992 Brown et al. ..... 215/100 A
5,148,930 A 9/1992 Ota et al. ..... 215/1 C
5,156,285 A 10/1992 Zogg et al. ..... 215/100 A
5,158,190 A 10/1992 Sosenko ..... 215/1 R
5,165,557 A 11/1992 Ota et al. ..... 215/1 C
5,178,289 A 1/1993 Krishnakumar et al. .... 215/1 C
5,178,290 A 1/1993 Ota et al. ..... 215/1 C
D334,713 S 4/1993 Segati ..... D9/543
5,199,587 A 4/1993 Ota et al. ..... 215/1 C
5,199,588 A 4/1993 Hayashi ..... 215/1 C
5,215,203 A 6/1993 Malcolm ..... 215/100 A
5,222,615 A 6/1993 Ota et al. ..... 215/1 C
D337,520 S 7/1993 Krishnakumar et al. ..... D9/434
5,224,614 A 7/1993 Bono et al. ..... 215/100 A
5,226,550 A * 7/1993 Mikolaitis et al. ..... 215/384
5,255,889 A 10/1993 Collette et al. ..... 249/102
5,261,543 A 11/1993 Ugarelli ..... 215/1 C
5,279,433 A 1/1994 Krishnakumar et al. .... 215/1 C
D344,457 S 2/1994 Prevot et al. ..... D9/537
D345,693 S 4/1994 Edstrom ..... D9/332
5,303,833 A 4/1994 Hayashi et al. ..... 215/1 C
5,303,834 A 4/1994 Krishnakumar et al. .... 215/1 C
D347,391 S 5/1994 Guertin ..... D9/566
5,322,184 A 6/1994 Bergner et al. ..... 220/771
5,330,054 A 7/1994 Brown ..... 206/459.5
5,337,909 A 8/1994 Vailliencourt ..... 215/1 C
5,341,946 A 8/1994 Vailliencourt et al. ..... 215/1 C
5,350,078 A 9/1994 Potts et al. ..... 215/384
D352,238 S 11/1994 Vailliencourt et al. ..... D9/434
D352,245 S 11/1994 Krishnakumar et al. ..... D9/538
5,381,910 A 1/1995 Sugiura et al. ..... 215/1 C
5,392,937 A * 2/1995 Prevot et al. ..... 215/384
D357,188 S 4/1995 Stockwell et al. ..... D9/543
5,407,086 A 4/1995 Ota et al. ..... 215/1 C
D358,333 S 5/1995 Stockwell et al. ..... D9/531
D358,547 S 5/1995 Darr ..... D9/520
D358,766 S 5/1995 Vailliencourt et al. ..... D9/434
5,411,699 A * 5/1995 Collette et al. ..... 264/523
5,413,244 A 5/1995 Ramsey ..... 220/671
D359,449 S 6/1995 Ota et al. ..... D9/434
D360,582 S 7/1995 McDonald et al. ..... D9/520
5,431,291 A 7/1995 LaBombarbe, Jr. ..... 215/44
5,435,451 A 7/1995 Dyer ..... 215/400
D364,565 S 11/1995 Vailliencourt et al. ..... D9/434
5,472,105 A 12/1995 Krishnakumar et al. .... 215/384
D366,416 S 1/1996 Semersky ..... D9/434
D366,417 S 1/1996 Semersky ..... D9/434
D366,831 S 2/1996 Semersky et al. ..... D9/434
D369,110 S 4/1996 Dyer ..... D9/520
D376,978 S 12/1996 Silvers et al. ..... D9/434
5,579,937 A 12/1996 Valyi ..... 215/384
5,593,056 A 1/1997 Mero et al. ..... 215/382
D377,904 S 2/1997 Hestehave et al. ..... D9/552
5,598,941 A * 2/1997 Semersky et al. ..... 215/384
D379,763 S 6/1997 Ewing, Jr. ..... D9/520
5,637,167 A 6/1997 Krishnakumar et al. ..... 156/85
D381,272 S 7/1997 Coons ..... D9/540
D382,485 S * 8/1997 Krishnakumar et al. ..... D9/543
D382,799 S 8/1997 Darr ..... D9/434
D382,807 S 8/1997 Silvers et al. ..... D9/520
D383,067 S 9/1997 Gower et al. ..... D9/520
5,669,520 A 9/1997 Simpson ..... 215/11.1
5,671,864 A 9/1997 Caruthers ..... 220/737
D385,497 S 10/1997 Krishnakumar et al. ..... D9/543
D386,088 S 11/1997 Satoh ..... D9/536
D386,418 S 11/1997 Edstrom et al. ..... D9/538
5,682,931 A 11/1997 Mouchmouchian ..... 141/319
5,690,244 A 11/1997 Darr ..... 215/382
D387,284 S 12/1997 Briggs et al. ..... D9/552
5,704,503 A 1/1998 Krishnakumar et al. .... 215/381
5,704,506 A 1/1998 Tobias et al. ..... 215/398
5,711,445 A 1/1998 Robbins, III ..... 220/8
D390,114 S 2/1998 Young ..... D9/520
D390,116 S 2/1998 Larkin et al. ..... D9/528
D391,160 S 2/1998 Lauth ..... D9/502
D391,168 S 2/1998 Ogg ..... D9/538
5,713,681 A 2/1998 Venne et al. ..... 401/202
5,732,838 A 3/1998 Young ..... 215/384
D393,210 S 4/1998 Ewing, Jr. ..... D9/543
D393,802 S 4/1998 Collette et al. ..... D9/502
5,735,420 A 4/1998 Nakamaki et al. ..... 215/373
5,735,421 A 4/1998 Deemer et al. ..... 215/382
5,740,934 A 4/1998 Brady ..... 215/381
5,758,790 A 6/1998 Ewing, Jr. ..... 215/384
5,762,221 A 6/1998 Tobias et al. ..... 215/381
5,785,197 A 7/1998 Slat ..... 215/375
5,803,290 A 9/1998 Bongiorno ..... 215/384
D406,065 S 2/1999 Cheng ..... D9/434
5,908,127 A 6/1999 Weick et al. ..... 215/382 X
5,908,128 A 6/1999 Krishnakumar et al. 215/382 X
D415,681 S 10/1999 Yourist ..... D9/434
D419,872 S 2/2000 Lane ..... D9/434
D420,587 S 2/2000 Cheng et al. ..... D9/434
D429,152 S 8/2000 Lane ..... D9/434
D429,156 S 8/2000 Williams et al. ..... D9/520
D429,166 S 8/2000 Ogg ..... D9/552
D431,465 S 10/2000 Cheng et al. ..... D9/434
D432,019 S 10/2000 Steward ..... D9/538
D435,219 S 12/2000 Williams et al. ..... D9/538
6,164,474 A * 12/2000 Cheng et al. ..... 215/384
6,230,912 B1 5/2001 Rashid ..... 215/383
6,349,839 B1 * 2/2002 Mooney ..... 215/384
6,398,052 B1 6/2002 Cheng et al. ..... 215/384

* cited by examiner

HOT-FILLABLE CONTAINER WITH GRIP

This Application claims the benefit of Provisional Application No. 60/295,911 filed Jun. 4, 2001.

BACKGROUND

This application relates to blow-molded containers, and more particularly to hot-fillable containers having integral grip portions formed therein.

Perishable beverage and food products are often placed into containers at elevated temperatures. In a conventional hot-fill process, the liquid or flowable product is charged into a container at elevated temperatures, such as 180 to 190 degrees F, under approximately atmospheric pressure. Because a cap hermetically seals the products within the container while the products are at the hot-filling temperature, hot-fill plastic containers are subject to negative internal pressure (that is, relative to ambient pressure) upon cooling and contraction of the products and any entrapped air in the head-space.

It has been an inherent goal of conventional hot-fill container design to form stiff cylindrical portions (in transverse cross section) that maintain a cylindrical shape upon cooling. Thus, conventional hot-fill containers include designated flexing portions—vacuum panels—that deform when subject to typical hot-fill negative internal pressures. The inward deflection of the vacuum panels tends to equalize the pressure differential between the interior and exterior of the container so as to enhance the ability of the cylindrical sections to maintain an attractive shape, to enhance the ease of labeling, or like commercial appeal. Some container designs are symmetric about a longitudinal centerline and designed with stiffeners to maintain the intended cylindrical shape while the vacuum panels deflect. For example, U.S. Pat. Nos. 5,178,289, 5,092,475, and 5,054,632 teach stiffening portions or ribs to increase hoop stiffness and eliminate bulges while integral vacuum panels collapse inwardly. U.S. Pat. No. 4,863,046 is designed to provide volumetric shrinkage of less than one percent in hot-fill applications.

Other containers include a pair of vacuum panels, each of which has an indentation or grip portion enabling the container to be gripped between a user's thumb and fingers. For example, U.S. Pat. No. 5,141,120 teaches a bottle having a hinge continuously surrounding a vacuum panel, which includes indentations for gripping. In response to cooling of the container contents, the hinge enables the entire vacuum panel to collapse inwardly. U.S. Pat. No. 5,141,121 similarly teaches a bottle having an outward bulge that inverts in response to cooling of the container contents. Each of the patents referred to herein by patent number is incorporated by reference in its entirety.

Some hot-fill technology employs charging the product under atmospheric pressure (that is, gravity filling). However, metering the products under a positive pressure pumping system has been found to increase the accuracy and precision of the product volume charged into the container. Such positive pressure filling systems enable better accuracy and precision of the predetermined product volume, better control of the headspace volume, and other benefits. The metering typically subjects the container to a positive pressure (relative to ambient pressure) of a few PSI during charging. Typical charging pressures may be 1 to 2 PSI, although 5 PSI or greater may be encountered in certain circumstances. After filling, the pressure is typically released by exposing the contents to approximately atmospheric pressure prior to capping. It is a goal to provide improved containers.

SUMMARY

Conventional containers often include stiffeners to enhance the stiffness of portions thereof. Some containers even have stiffeners within the vacuum panels themselves. It has been found that stiffened containers may have a tendency to form a crease or kink in the container sidewall upon being subjected to the positive pressures inherent in pressure filling technology and techniques. In this regard, the sidewall forms an undesirable outer bulge or crease, thereby weakening the sidewall. Further, sometimes the sidewall crease does not snap back towards a cylindrical shape upon pressure release. Thus, stiffeners intended to maintain a cylindrical container shape or resist distortion, in some circumstances, may result in a container that is overly stiff and subject to creasing, and the stiffeners tend to inhibit the creased sidewall from snapping back upon pressure release.

A hot-fillable container formed by blow molding a thermoplastic is provided. The container comprises a neck portion, an enclosed bottom portion, and a body portion. The body portion is disposed between the neck portion and the bottom portion and includes a substantially cylindrical front segment, a substantially cylindrical rear segment opposite the front segment, and a pair of opposing handgrips disposed therebetween.

Each one of the handgrips includes a relatively stiffened boundary that resists deformation upon internal vacuum conditions and a relatively un-stiffened boundary. The relatively unstiffened boundary is disposed opposite from the relatively stiffened boundary and non-parallel thereto such that a portion of the handgrip forms a thumb piece. The panels are joined to said rear segment of the body portion without hinges so as to promote inward deformation of portions of the rear segments proximate the panels upon internal vacuum conditions. A rear portion of each one of the panels may be joined to the rear segment of the body portion without a hinge. The handgrips may be hingeless. The handgrip may have a depth that is greater proximate the relatively stiffened boundary than proximate the relatively unstiffened boundary. Each one of the panels may be formed by a shim-able insert such that the bottle volume is adjustable. Each one of the panels includes a handgrip formed therein.

Preferably, after deforming upon hot-filling, capping, and cooling, the bottle deforms less than approximately 2.0 mm at any location on the bottle compared with dimensions after blow-molding. Such deformation may be created upon filling of the container at a temperature up to approximately 220 degrees, above approximately 135 degrees F, between approximately 170 degrees F and approximately 195 degrees F, and/or between approximately 180 degrees F to approximately 195 degrees F.

BRIEF DESCRIPTION OF THE FIGURES

The patent or application file contains at least one drawing executed in color. Copies of this patent or patent application publication with color drawing(s) will be provided by the office upon request and payment of the necessary fee.

DETAILED DESCRIPTION OF PREFERRED EMBODIMENTS

Figure 1:
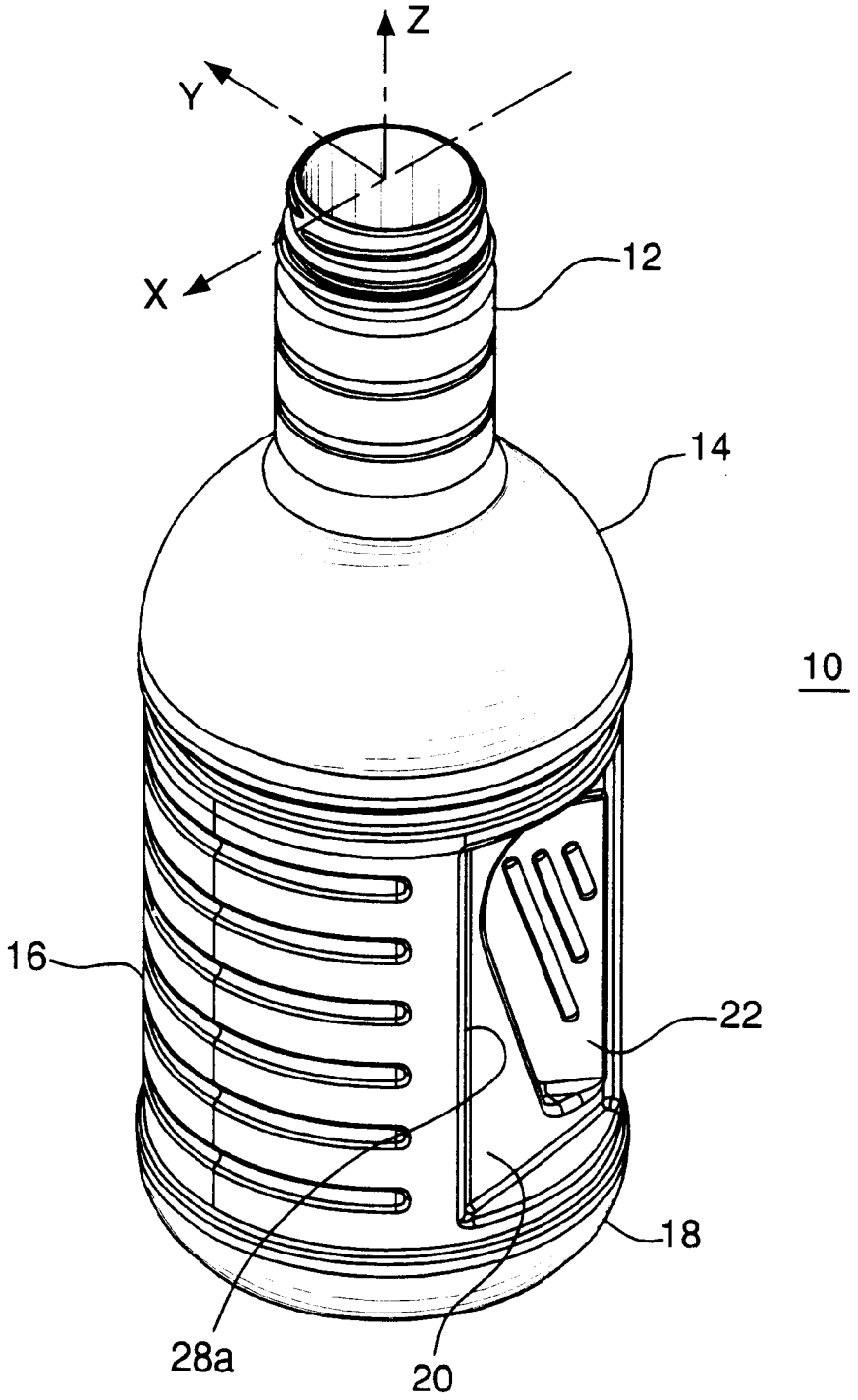
FIG. 1 is a perspective view of a container according to an aspect of the present invention.

As illustrated in FIGS. 1 through 5, a container 10 includes a neck 12, a dome portion 14, a body 16 and a base or bottom 18. Neck 12 extends upwardly from dome 14 and includes threads formed thereon for receiving a closure (not shown). Dome 14 extends between neck 12 and body 16. Base 18 encloses the lower portion of body 16, and may include any upwardly extending portion or geometry (not shown). Body 16 includes a pair of opposing panels 20 disposed between a rear sidewall portion 24 and a front sidewall portion 26. Rear sidewall 24 is opposite front sidewall 26, and each are substantially cylindrical in shape (that is, each is a segment of a substantially cylindrical shape). Preferably, the cylindrical shape preferably is circular in transverse cross section. Each of portions 24 and 26 includes horizontal ribs for stiffening so as to maintain the substantially cylindrical shape. Thus, each of sidewalls 24 and 26 is suitable for receiving a conventional label thereon. For ease of reference, each of FIGS. 1 through 5 includes mutually orthogonal axes x, y, and z. The positive x-axis is defined as oriented from rear sidewall 24 to front sidewall 26. Vertical axis z is co-linear with the longitudinal centerline of container 10.

Figure 4:
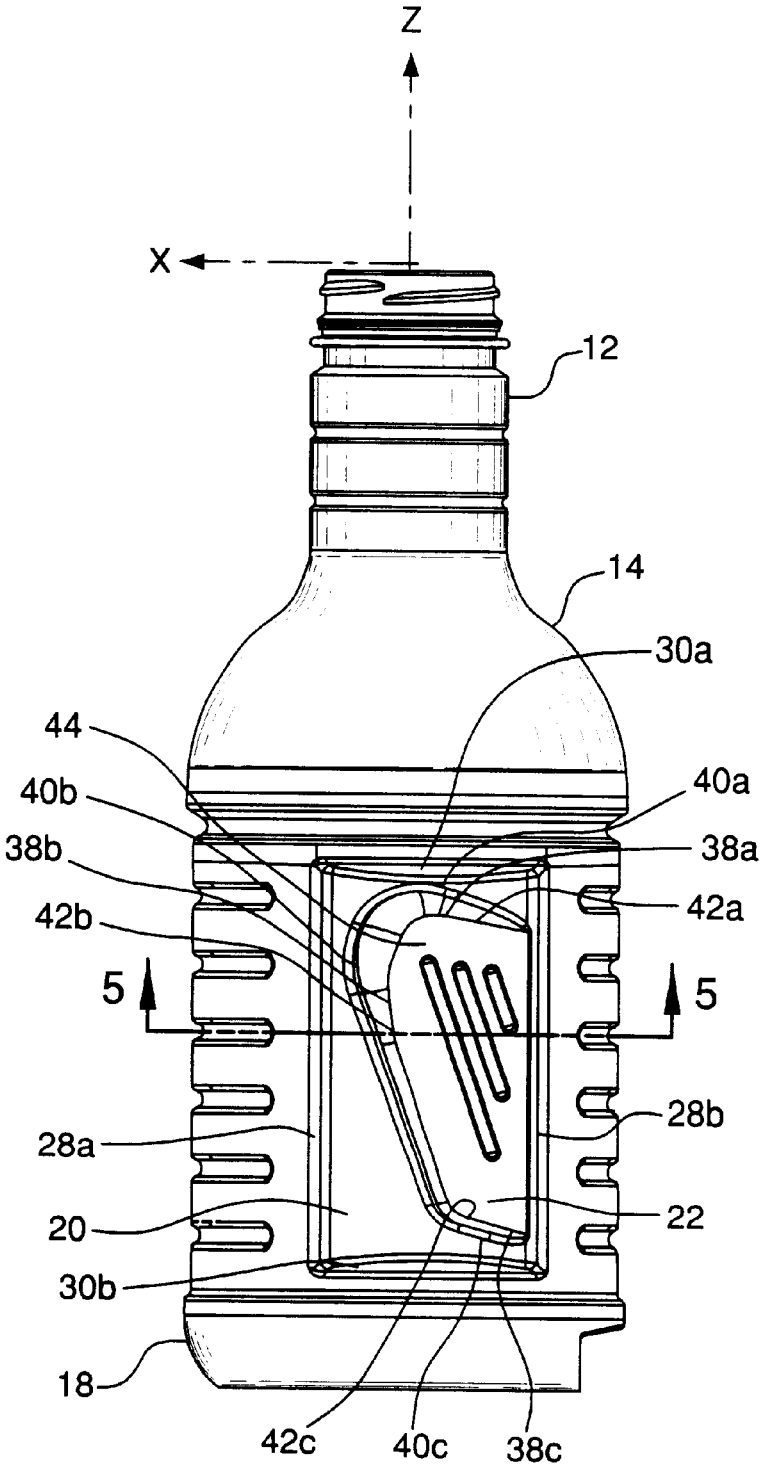
FIG. 4 is a side elevation view of the container of FIG. 1.
Figure 5:
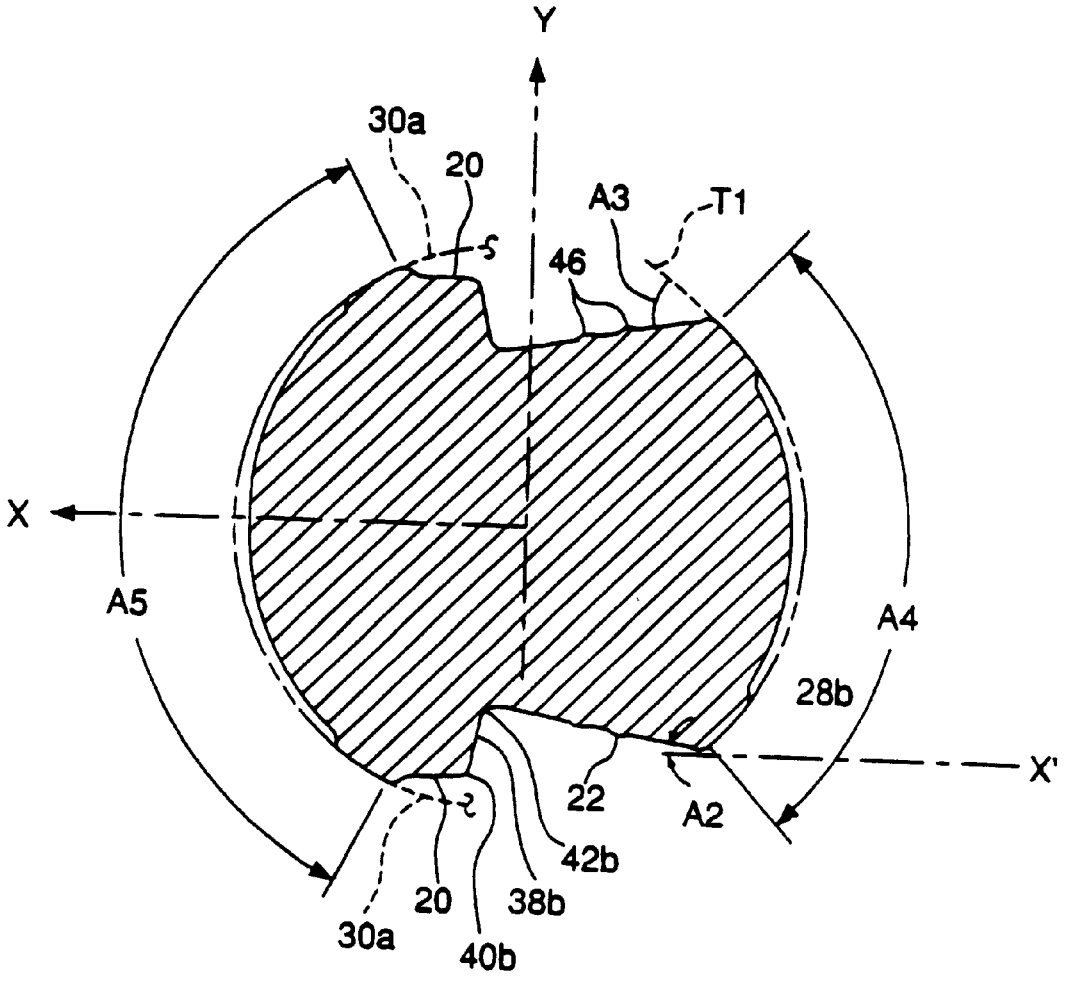
FIG. 5 is a transverse cross sectional view taken through line 5—5 in FIG. 4.

As best shown in FIGS. 4 and 5, each panel 20 includes a peripheral edge including: a substantially straight distal edge 28*a*; an opposing, substantially straight proximal edge 28*b*; an upper shoulder 30*a*; and a lower shoulder 30*b*. Edges 28*a* and 28*b* preferably smoothly merge into rear and front portions 24 and 26. Shoulders 30*a* and 30*b* extend between panel 20 and a cylindrical portion of container 10 above and below panel 20. Preferably panel 20 is substantially planar, as best shown in FIGS. 1 and 5. Edges 28*a* and 28*b* provide, in transverse cross section, the transition between the circular sides 24 and 26 and the subtending straight portion 20, and between the circular sides of body 16 above and below panel 20 and the subtending straight portion 20. In this regard, panel 20 has an outer edge having an overall rectangular shape formed by substantially parallel sides 28*a* and 28*b* and by substantially parallel shoulders 30*a* and 30*b*. As best shown in FIG. 4, each of shoulders 30*a* and 30*b* form an arc where it meets the flat portion of panel 20. A portion of shoulder 30*a* is shown in phantom in FIG. 5 to further illustrate such configuration.

As shown schematically in FIG. 5, panel 20 preferably is formed by an removable insert 62 into a mold 60 in which container 10 is blown. Such an insert preferably is capable of being shimmed relative to the remainder of the mold such that the depth of panel 20 can be modified to modify the volume, thereby enabling the volume of the containers to be adjusted in a predetermined manner. Shims are indicated schematically by reference numeral 64, and are shown schematically in outline in FIG. 4 generally to indicate that panel 20 may be shimmed. Persons familiar with blow molding technology and design will understand forming containers in molds that employ removable inserts, and will understand that the present invention is not limited to the particular shape or configuration of shims, nor to the particular outline of the shimmed portion, that is shown.

Further, aspects of the present invention (including but not limited to panel configuration and design, shimming aspects, and others) are illustrated by employing a particular geometry of container 10, including, but not limited to, panels 20. The present invention is not limited to such particular geometry, but rather encompasses any structure that is recited in the claims or structure that functions as described in the claims.

Figure 2:
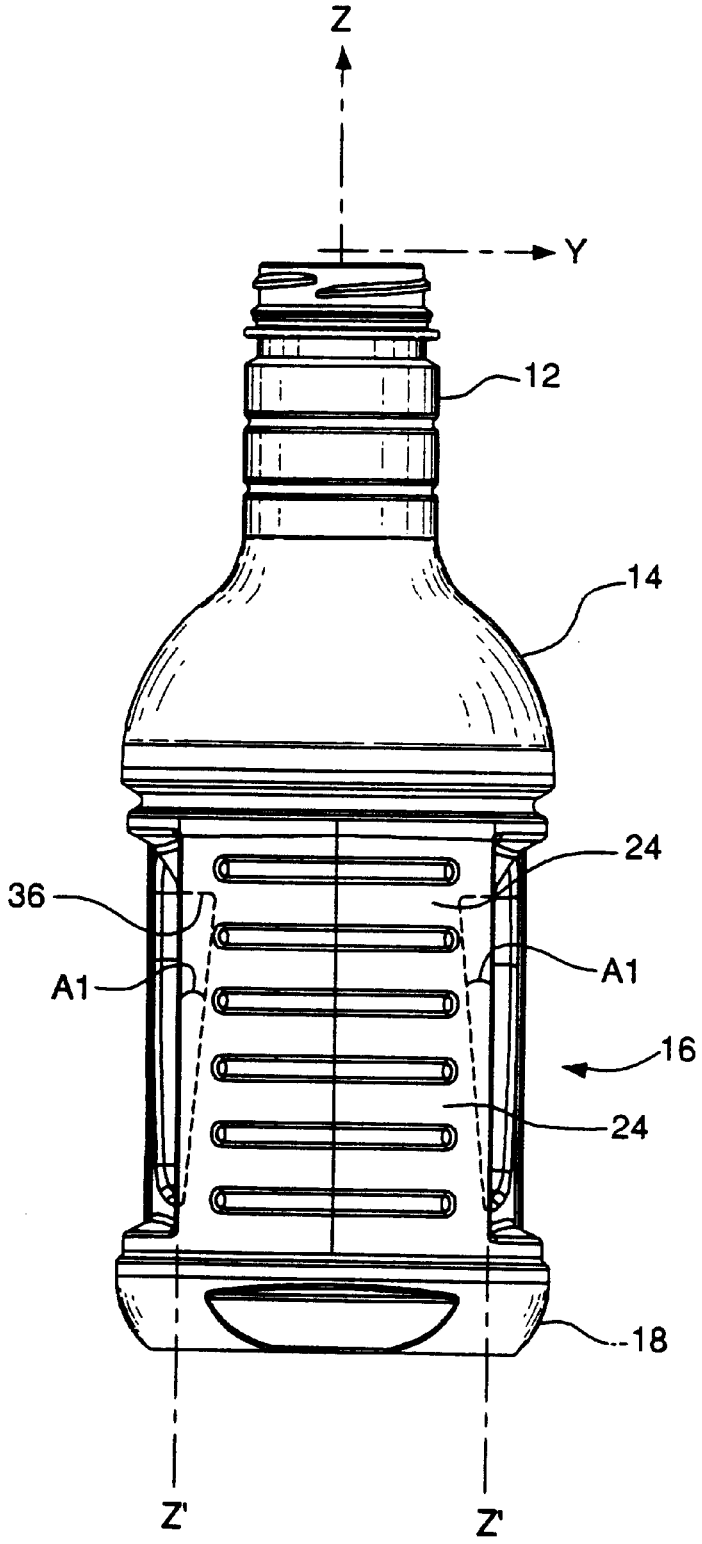
FIG. 2 is a rear elevation view of the container of FIG. 1.
Figure 3:
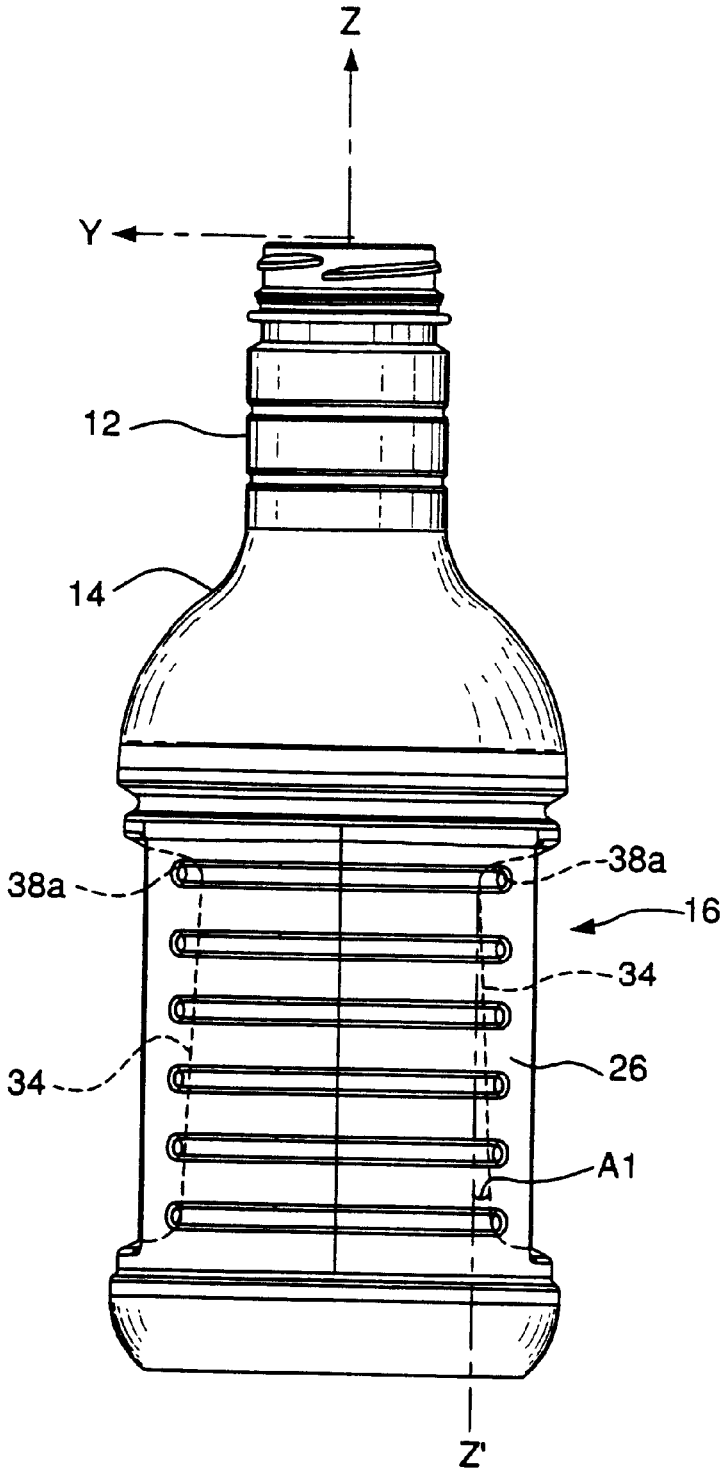
FIG. 3 is a front elevation view of the container of FIG. 1.

Grip 22 extends inwardly from panel 20 so as to form an indentation suitable for gripping by a user's hand. As best shown in FIGS. 1, 4, and 5, grip 22 includes a main grip surface 34 and a grip wall 36 (FIG. 2). As shown in phantom in FIGS. 3 and 4, grip surface 34, which preferably is planar, is inclined relative to plane x-z (that is, the plane defined by axes x and z) by an angle A1 such that grip 22 has a depth (that is, the radial distance between the projected, imaginary cylinder and a point on grip surface 34) that is non-uniform within grip 22. Angle A1 is measured between the z-axis and the projection of the innermost surface (that is, the portion that protrudes toward centerline z) of panel 20 onto the y-z plane (indicated by line z') as shown in FIGS. 2 and 3. The magnitude of angle A1 may be determined according to the desired grip characteristics (including depth and other dimensions), panel dimensions (including depth and other dimensions), and related parameters, as well as for its deformation characteristics as described below. For the particular configuration of the embodiment shown in the Figures for a 48 ounce volumetric size, angle A1 preferably is between 4 and 12 degrees, more preferably between 5 and 10 degrees, and even more preferably approximately 7 degrees.

Thus, grip wall 36 is formed by a grip upper wall 38*a*, distal grip wall 38*b*, and lower grip wall 38*c*, which vary in depth. Each grip wall 38*a*, 38*b*, and 38*c* has an outer transition 40*a*, 40*b*, and 40*c*, respectively, that preferably gradually merges wall 38*a*, 38*b*, and 38*c* into panel 20 and has an inner transition 42*a*, 42*b*, and 42*c* that preferably abruptly (that is, having a small radius so as to substantially form a corner) merges wall 38*a*, 38*b*, and 38*c* into grip surface 34.

In this regard, grip wall 36 forms a modified C-shape such that each wall 38*a*, 38*b*, and 38*c* has a straight section that merges into a rounded transition between upper wall 38*a* and distal wall 38*b*, and between lower wall 38*c* and distal wall 38*b*. According to an aspect of the present invention (which is independent of other aspects described herein) and as shown in the Figures, upper and lower walls 38*a* and 38*c* have a depth that increases at distal ends that merge with distal wall 38*b*, and a depth that gradually decreases to substantially zero at opposing proximal ends such that walls 38*a* and 38*c* smoothly merge into panel 20. Distal wall 38*b* has a depth that, upwardly toward upper wall 38*a*, gradually increases to form a thumb piece (or, opposite, a finger piece) indentation 44 substantially at the portion of panel 20 having the greatest depth. In this regard, panel 20 may substantially be a plane that is inclined to the substantially vertical panel proximal edge 28*b*. Further, upper wall 38*a* is inclined from a horizontal reference to receive a user's thumb (or forefinger or index finger) at a natural gripping angle, thereby enhancing gripping ease and comfort.

According to an aspect of the present invention, grip surface 34 (that is, the flat portion of grip 22) has a boundary that is formed by proximal edge 28*b* of panel 20 and is not indented therefrom (that is, a portion of grip surface 34 at the open end of its C-shape is unbounded by walls 38*a*, 38*b*, and 38*c*). Rather, grip surface 34 smoothly merges into rear sidewall 34 without a hinge or like structure therebetween. Grip surface 34 gradually increases in depth from rear sidewall portion 24 toward front sidewall portion 26 and gradually increases in depth from a lower portion thereof (defined by lower wall 38*c*) toward an upper portion thereof (defined by upper wall 38*a*), thereby forming thumb piece 44. Further, grip walls 38*a*, 38*b*, and 38*c* are oriented substantially radially so as to provide a relatively large moment of inertia to resist deformation inherent in hot-filling technology. Such a configuration provides a comfortable grip while thumb piece 44 enables secure grasping. Grip surface 34 includes, outwardly protruding ribs 46.

According to another aspect of the present invention, container 10 lacks hinges that enhance or facilitate deformation of a portion thereof. Further, even though panel edges 28*a*, 28*b*, 30*a*, and 30*b* visually resemble conventional vacuum panels, panel 20 does not collapse inwardly in response to negative internal pressure corresponding to cooling subsequent to a hot-fill process. Rather, inward deflection of the container walls relative to its pre-filled state is distributed beyond panel 20. Therefore, the maximum magnitude of such deflection of the container 10 is less than the maximum magnitude of corresponding deflection of prior art containers (that is, to achieve the same volumetric decrease). As shown in FIG. 6, the maximum magnitude inward deflection of the embodiment of container 10 for a 48 ounce container size is less than approximately 1.8 millimeters.

Further, according to another aspect of the present invention, panel 20 includes a handgrip 22 having a stiffened wall 36 proximate the distal portion of grip 22 (that is, relative to the user's hand position) that resists deformation upon internal vacuum conditions, as well as a substantially un-stiffened proximal portion or edge (into which grip 22 merges). Thus, the relatively stiffened portion and relatively unstiffened portion are disposed on opposing sides of grip 22. In this regard, the stiffening provided by grip wall 36 increases as the depth of grip wall 36 increases. Thus, the grip wall 36 is most stiff at the upper left portion of grip 34 (as oriented in FIG. 4), and the stiffening gradually decreases toward the proximal edge of upper wall 38*a* and lower wall 38*c*. The stiffening where grip 34 merges into rear sidewall 24 is minimal.

As indicated in FIG. 5, an angle A2 is formed by the planar portion of grip 22 and the x-z plane, which is indicated on FIG. 5 by line x'. The magnitude of angle A2 may be chosen according to the desired depth of grip 22 and like dimensions. In the embodiment shown in the Figures, angle A2 may be preferably between approximately 5 and 20 degrees, more preferably between 8 and 16 degrees, and most preferably approximately 12 degrees. Grip 22 forms and angle A3 with a tangent line T1 drawn on rear sidewall 24 and edge 28*b*. The magnitude of angle A3 depends upon the desired depth of grip 22, as well as upon and angle A2 and the arc A4 defining the rear portion 24, which is indicated by arc A4 on FIG. 5. Preferably, angle A3 is approximately between 35 and 65 degrees, preferably between 45 and 65 degrees, and more preferably about 50 degrees. The angles A4 and A5 defining rear and front sidewalls 24 and 26 are approximately 83 and 100 degrees, respectively.

Figure 6A:
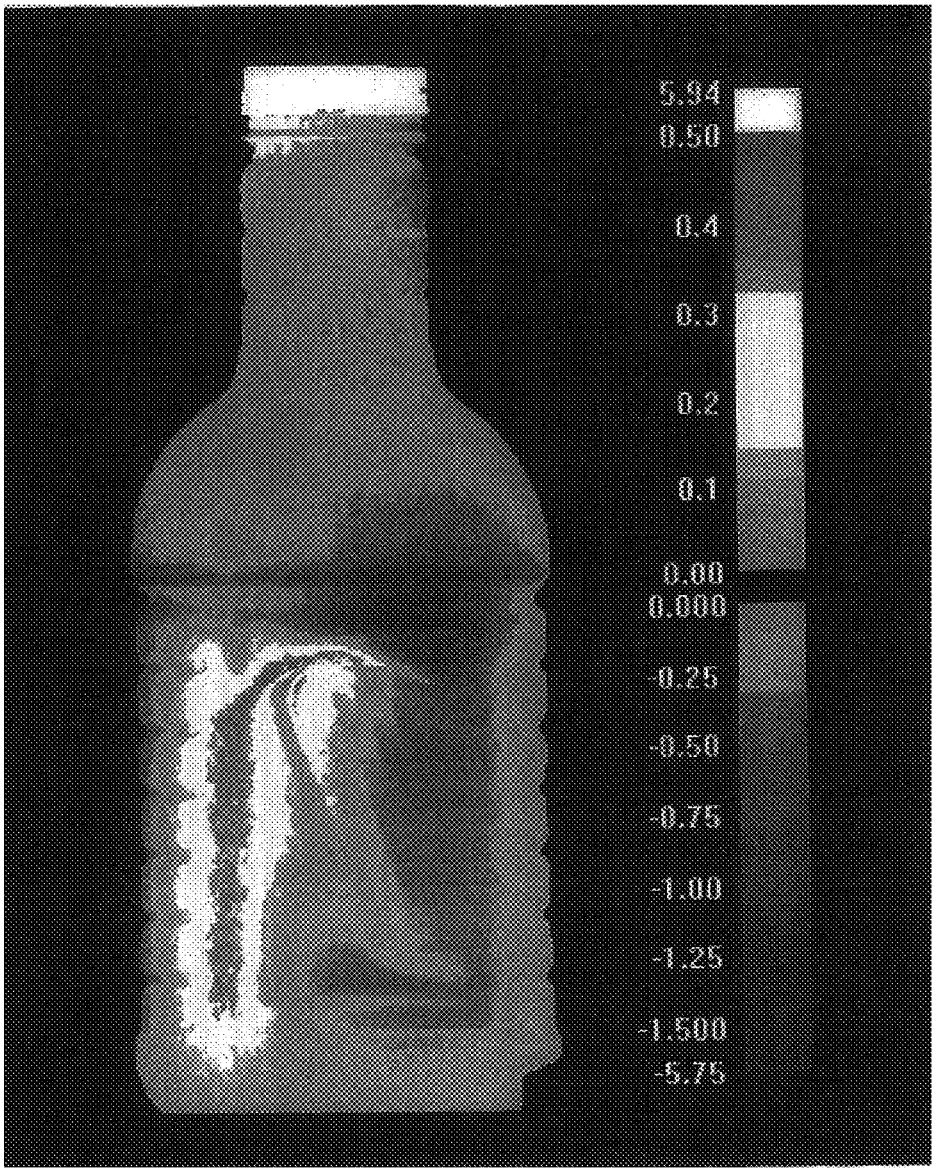
FIG. 6A is a color deformation diagram of a first side of a bottle indicating the magnitude of inward and outward deformation of the bottle between its pre-filling, blow molded state and its final, hot-filled, cooled state with a scale in millimeters.
Figure 6B:
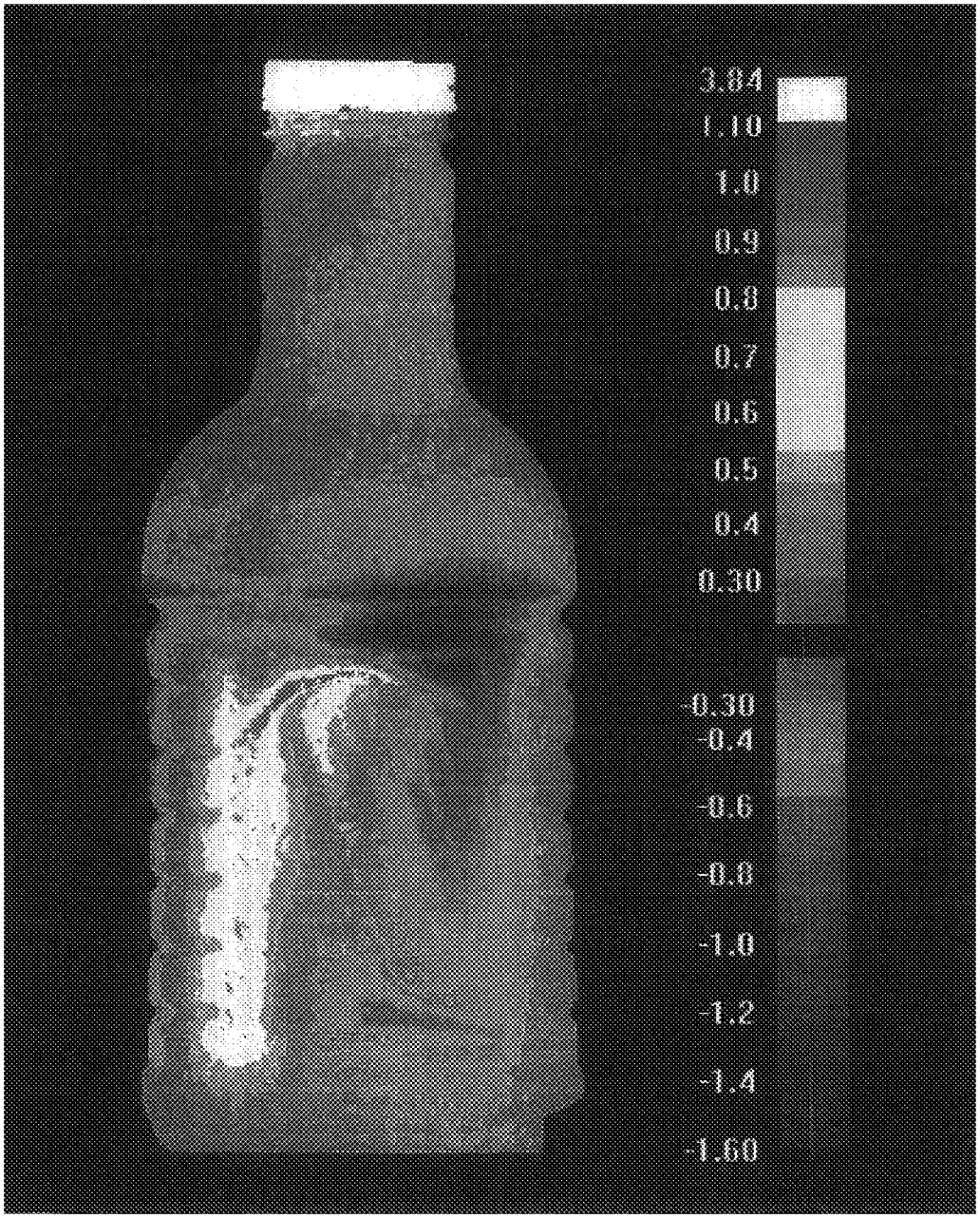
FIG. 6B is a color deformation diagram of the first side of the bottle of FIG. 6A but employing a different color scale.
Figure 7A:
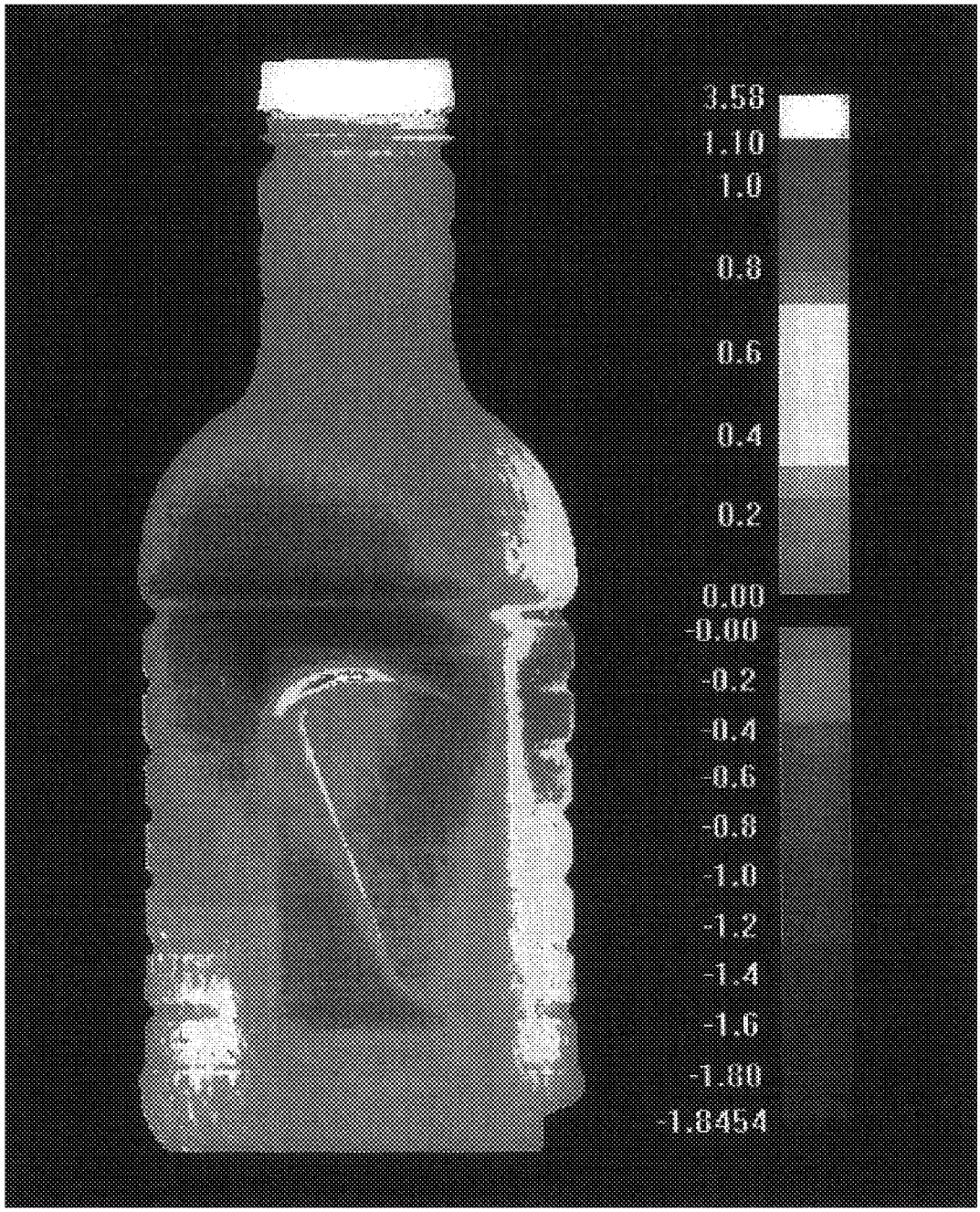
FIG. 7A is a color deformation diagram of a first side of another bottle.
Figure 7B:
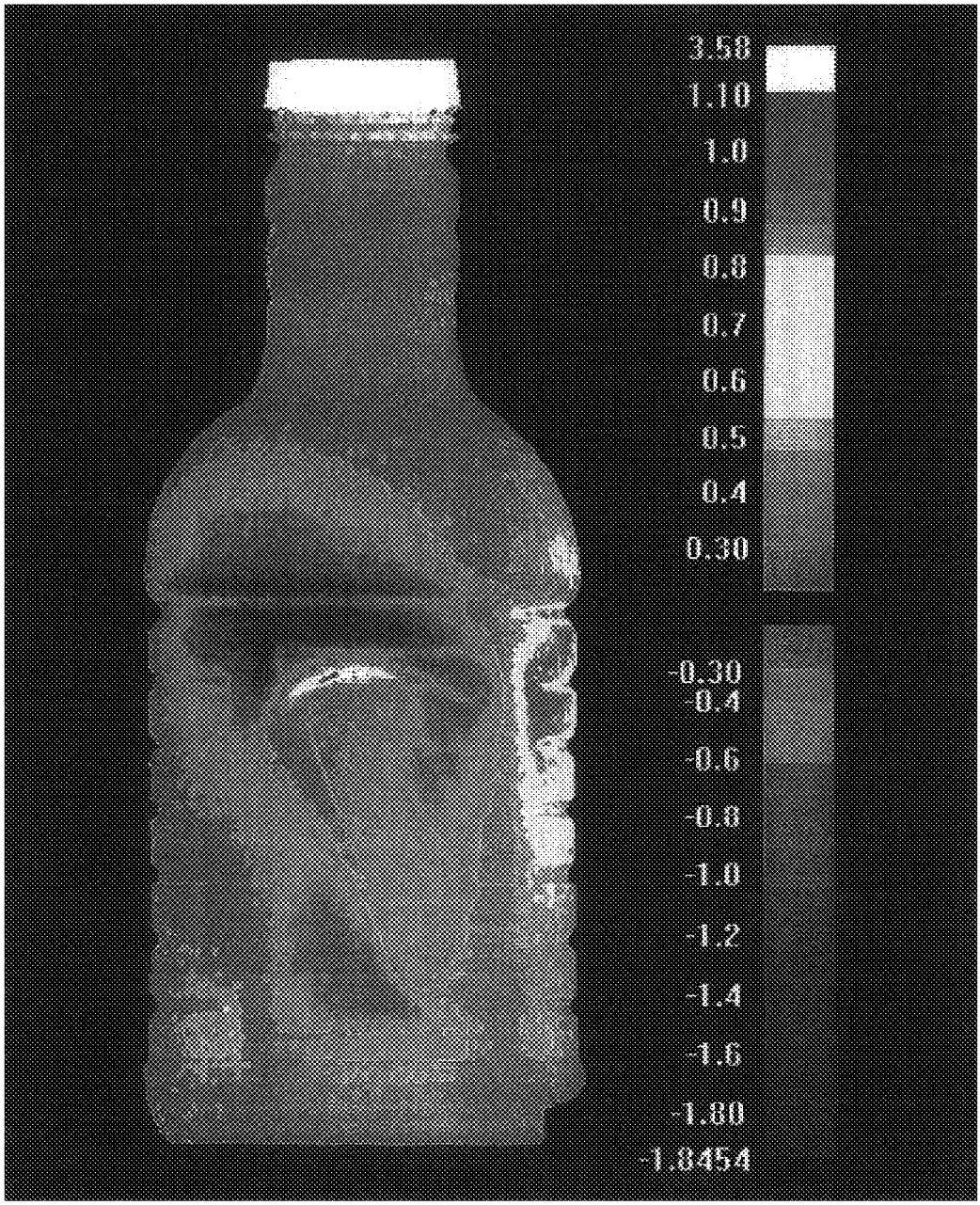
FIG. 7B is a color deformation diagram of the first side of the bottle of FIG. 7B but employing a different color scale.
Figure 8A:
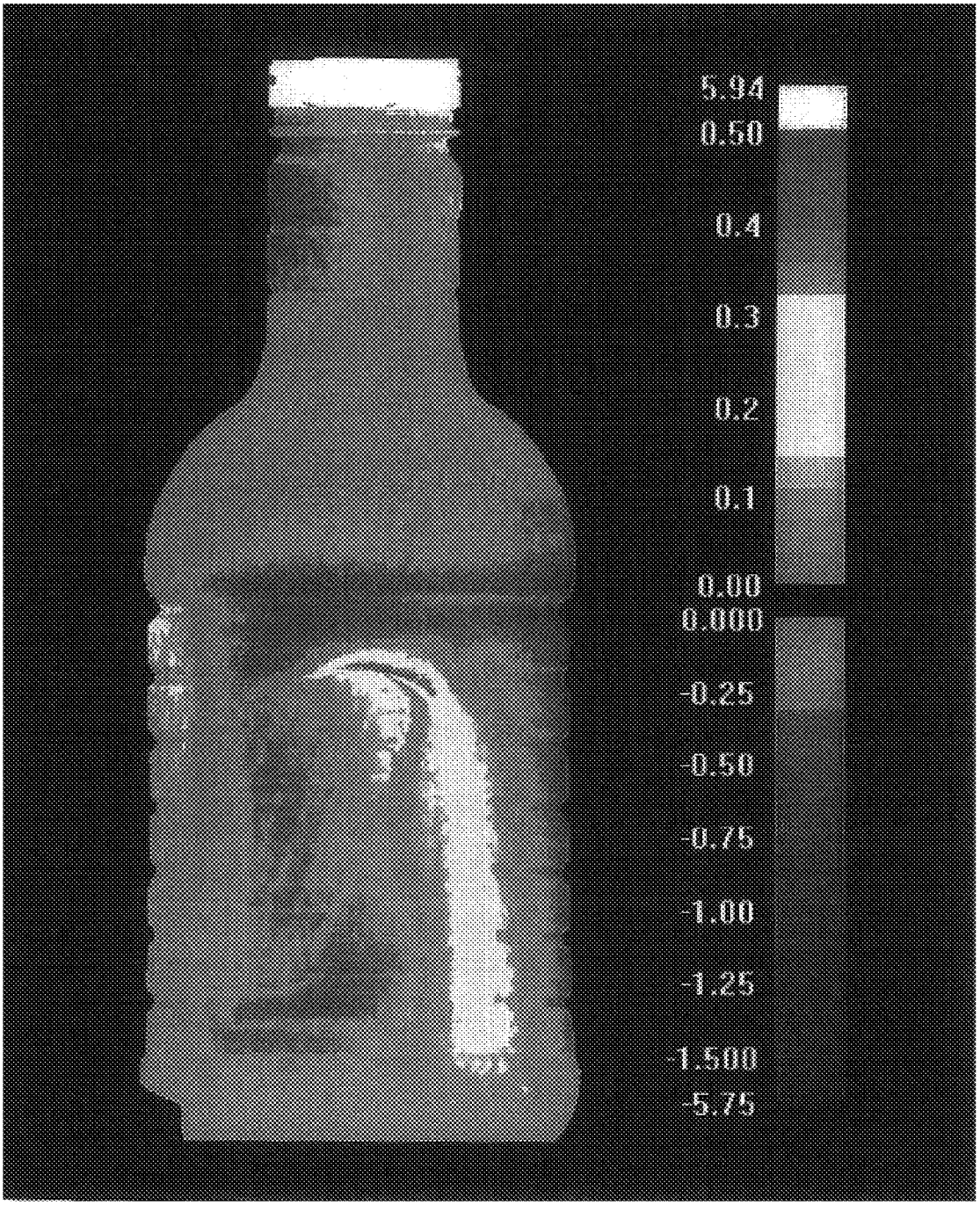
FIG. 8A is a color deformation diagram of a second side of the bottle of FIG. 6A.
Figure 8B:
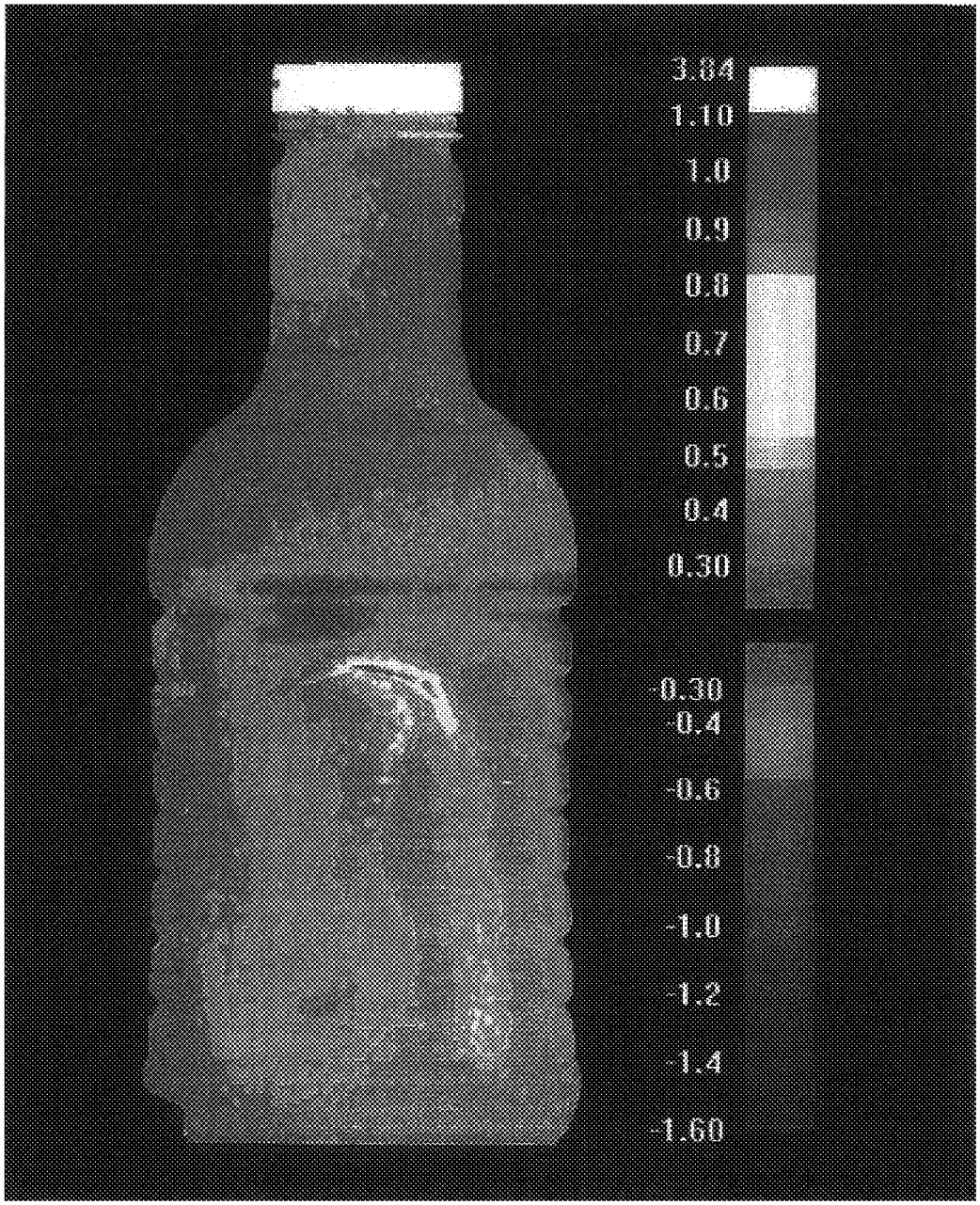
FIG. 8B is a color deformation diagram of the second side of the bottle of FIG. 8A but employing a different color scale.
Figure 9A:
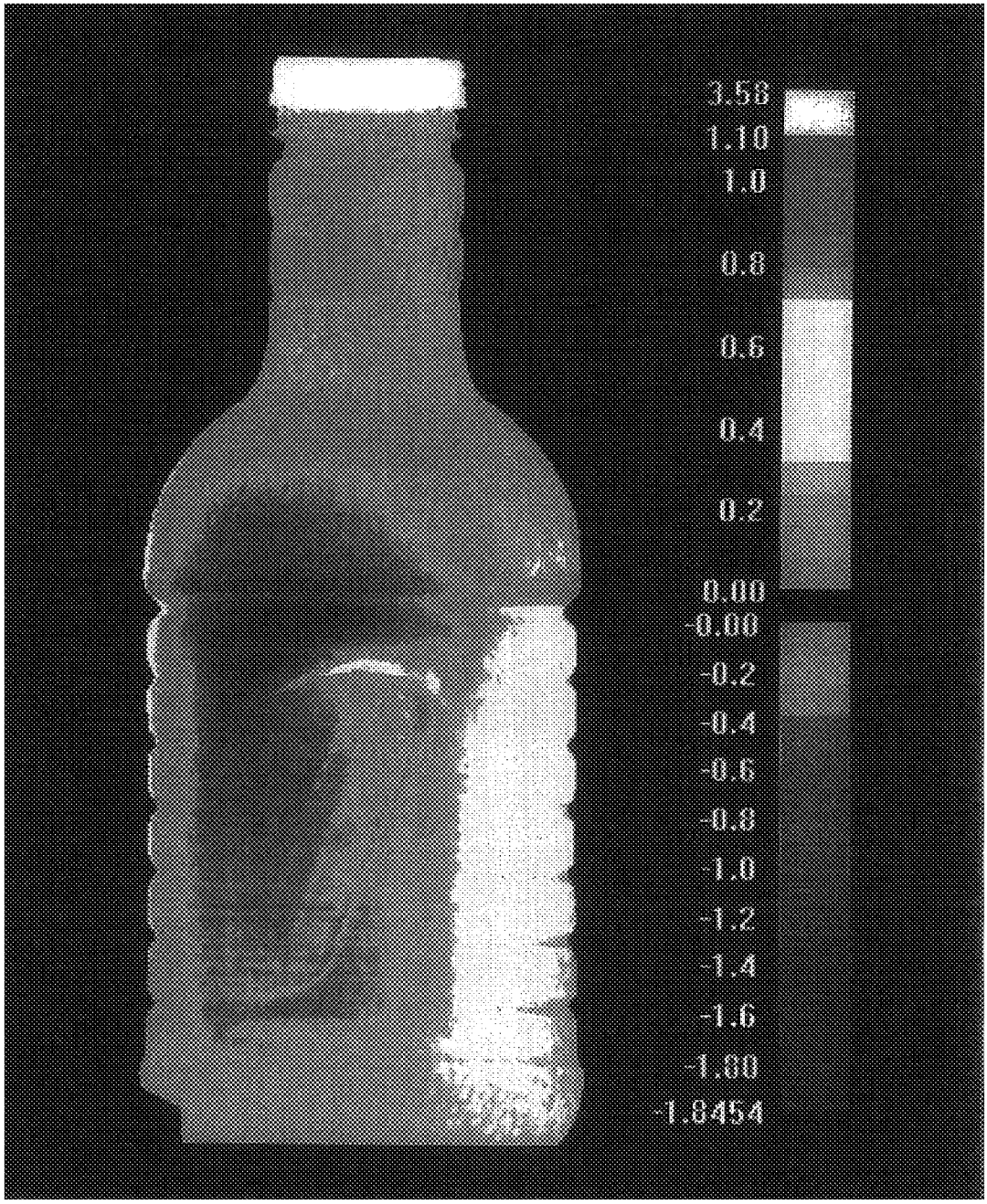
FIG. 9A is a color deformation diagram of the second side of the bottle of FIG. 7A.
Figure 9B:
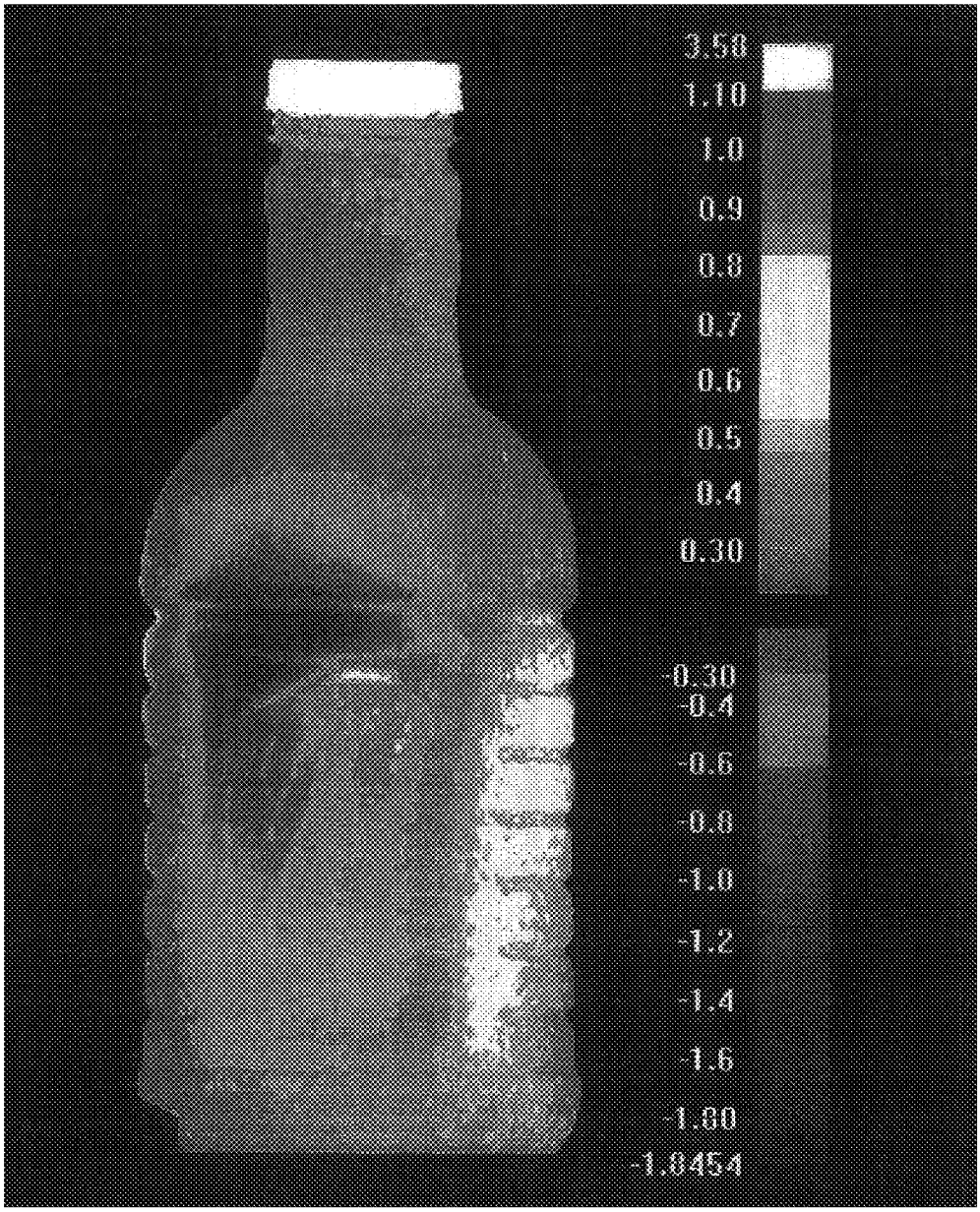
FIG. 9B is a color deformation diagram of the second side of the bottle of FIG. 9A but employing a different color scale.

To illustrate the vacuum deformation characteristics of container 10, and containers having like geometry, FIGS. 6A and 6B through 9A and 9B were produced by laser scanning a blow-molded container, and subsequently filling the container at a temperature of approximately 185 degrees at 1 to 2 PSI, releasing the pressure to expose the contents to atmospheric pressure, and capping the container while hot. After cooling, the filled container was again scanned to produce the data—that is, the graphic representation of the deformation of the bottle's surface from its pre-filled at-rest state, to it post-filling, cooled, vacuum deformed state—represented in the Figures. Such laser scanning technology is available from Digibotics, Inc. of Novi, Mich. FIGS. 6A and 6B show identical views of vacuum deformation of container 10, but employing different color scales to correspond to the magnitude of the container deformation. Similarly, each of the figures designated by an A and B extension show the same view but employ different color scales. FIGS. 8A and 8B show the opposing side view of the same container as shown in FIGS. 6A and 6B. FIGS. 7A and 7B show views of another container, and FIGS. 9A and 9B show the opposing side view of the same container as shown in FIGS. 7A and 7B.

As shown in FIGS. 6A and 6B through 9A and 9B, container 10 as configured above produces container deformation (that is, deformation of a hot-filled container upon cooling) that is not limited to panel 20, but rather is distributed over an area of the bottle that is larger than the panel area The deformation distribution is, at least in part, enhanced by the hingeless nature of panel 20 and/or handgrip 22. Further, the Figures illustrated that the the stiffened portion deflects significantly less than the un-stiffened portion. The configuration, however, is not prone to sidewall collapse of early containers.

Aspects of the present invention have been illustrated by employing the particular embodiment shown in the Figures. However, the present invention is not limited to the particular embodiment shown or described, but rather encompasses other container configurations embodying the inventive aspects described herein. Further, each aspect of the invention referred to in the specification is independent of other of such aspects such that the claims define the invention and no single aspect is relied upon as essential.

What is claimed is:

1. A hot-fillable container formed by blow molding a thermoplastic, said container comprising:

a neck portion;

an enclosed bottom portion; and a body portion disposed between the neck portion and the bottom portion, the body portion including a substantially cylindrical front segment, a substantially cylindrical rear segment opposite the front segment, a pair of opposing panels disposed between the front segment and the rear segment, and a pair of opposing handgrips formed in the panels, a rear portion of each one of the panels joined to the rear segment of the body portion without a hinge;

each one of the handgrips including a relatively stiffened boundary that resists deformation upon internal vacuum conditions and a relatively un-stiffened boundary, the relatively unstiffened boundary being disposed opposite from the relatively stiffened boundary and non-parallel thereto such that a portion of the handgrip forms a thumb piece;

whereby said panels being joined to said rear segment of the body portion without hinges promotes inward deformation of portions of the rear segments proximate the panels upon internal vacuum conditions.

2. The container of claim 1 wherein the handgrips are hingeless.

3. The container of claim 1 wherein the relatively stiffened boundary is formed by a distal grip wall extending therefrom.

4. The container of claim 3 wherein the distal grip wall is formed between a distal portion of the handgrip and the panel.

5. The container of claim 4 wherein the distal grip wall is at least partially radially oriented.

6. The container of claim 4 wherein the distal grip wall is substantially radially oriented.

7. The container of claim 1 wherein each one of the handgrips also includes an upper boundary formed between an upper portion of the handgrip and the panel.

8. The container of claim 7 wherein the handgrip is inclined relative to a longitudinal axis of the container.

9. The container of claim 7 wherein the handgrip has a depth that is greater proximate the relatively stiffened boundary than proximate the relatively unstiffened boundary.

10. The container of claim 9 wherein the depth increases from the relatively unstiffened boundary toward the stiffened boundary and gradually increases from a lower portion of the handgrip toward an upper portion of the handgrip.

11. The container of claim 10 wherein the relatively stiffened boundary is formed by a distal grip wall extending therefrom, the handgrip depth is greatest proximate an intersection of the distal grip wall and the upper portion.

12. The container of claim 1 wherein each off the panels is substantially planar.

13. The container of claim 12 wherein each of the grips define a substantially planar grip surface.

14. The container of claim 13 wherein each of the planes defined by the grip surfaces is inclined along two axes.

15. The container of claim 13 wherein the stiffened boundary is disposed on a distal portion of handgrip and the unstiffened boundary is disposed on a proximal portion of the handgrip, whereby the proximal and the distal boundaries are defined relative to a user's hand.

16. The container of claim 13 wherein the stiffening produced by the relatively stiffened boundary gradually diminishes toward the unstiffened boundary.

17. The container of claim 16 wherein the relatively unstiffened boundary smoothly merges into the container sidewall.

18. The container of claim 17 wherein the relatively unstiffened boundary lacks a hinge.

19. The container of claim 1 wherein each one of the panels is formed by a shimable insert such that the bottle volume is adjustable.

20. The container of claim 19 wherein said unstiffened boundary of each handgrip is formed by an edge portion of said panel.

21. The container of claim 1 wherein each one of the panels is defined by an outer edge having an adjustable depth by shimming of a panel insert within a mold.

22. The container of claim 1 wherein a front portion of each one of the panels is joined to the front segment of the body portion without a hinge, thereby promoting inward deformation of portions of the front segments proximate the panels upon internal vacuum conditions.

23. The container of claim 1 wherein said unstiffened boundary of each handgrip smoothly merges into said rear segment of said body portion.

24. A hot fillable container formed by blow molding a thermoplastic, said container comprising:

a neck portion;

an enclosed bottom portion; and a body portion disposed between the neck portion and the bottom portion, the body portion including a substantially cylindrical front segment, a substantially cylindrical rear segment opposite the front segment, a pair of opposing panels disposed between the front segment and the rear segment, and a pair of opposing handgrips formed in the panels;

each one of the handgrips including a relatively stiffened boundary that resists deformation upon internal vacuum conditions and a relatively un-stiffened boundary, the relatively unstiffened boundary being disposed opposite from the relatively stiffened boundary and non-parallel thereto such that a portion of the handgrip forms a thumb piece;

wherein the bottle deforms upon hot-filling, capping, and cooling less than approximately 2.0 mm at any location on the bottle compared with dimensions after blow-molding.

25. The container of claim 24 wherein said deformation is created by filling the container with contents at a temperature up to approximately 220 degrees.

26. The container of claim 25 wherein said deformation is created by filling the container with contents at a temperature above approximately 135 degrees F.

27. The container of claim 24 wherein said deformation is created by filling the container with contents at a temperature between approximately 170 degrees F. to approximately 195 degrees F.

28. The container of claim 24 wherein said deformation is created by filling the container with contents at a temperature between approximately 180 degrees F. to approximately 195 degrees F.

29. The container of claim 24 wherein each one of the panels is formed by a shimable insert such that the bottle volume is adjustable.

30. The container of claim 24 wherein each one of the panels is defined by an outer edge having an adjustable depth by shimming of a panel insert within a mold.

31. The container of claim 24 wherein said panels are joined to said rear segment of the body portion without hinges promotes inward deformation of portions of the rear segments proximate the panels upon internal vacuum conditions.

32. The container of claim 24 wherein a front portion of each one of the panels is joined to the front segment of the body portion without a hinge, thereby promoting inward deformation of portions of the front segments proximate the panels upon internal vacuum conditions.

* * * * *